US008033144B2

(12) United States Patent
Yoo et al.

(10) Patent No.: US 8,033,144 B2
(45) **Date of Patent: *Oct. 11, 2011**

(54) FOREIGN MATERIALS FILTERING APPARATUS AND WASHING MACHINE HAVING THE SAME

(75) Inventors: Sang-Hee Yoo, Gyeongsangnam-Do (KR); Jong-Deuk Bae, Gyeongsangnam-Do (KR); Bo-Young Chang, Gyeongsangnam-Do (KR); Young-Bae Park, Gyeongsangnam-Do (KR); Ji-Maeng Kim, Gyeongsangnam-Do (KR); Soo-Jin Jung, Gyeongsangnam-Do (KR); Ae-Na Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 792 days.

This patent is subject to a terminal disclaimer.

(21) Appl. No.: 12/041,780

(22) Filed: Mar. 4, 2008

(65) Prior Publication Data

US 2008/0216519 A1 Sep. 11, 2008

(30) Foreign Application Priority Data

Mar. 6, 2007 (KR) ..... 10-2007-0022177

(51) Int. Cl.
*D06F 39/10* (2006.01)

(52) U.S. Cl. ..... 68/18 F

(58) Field of Classification Search ..... 68/18 F; 134/111

See application file for complete search history.

(56) References Cited

U.S. PATENT DOCUMENTS

| | | | |
|---|---|---|---|
| 2,413,954 | A | 1/1947 | Conterman |
| 2,586,508 | A | 1/1952 | Brotman |
| 2,939,305 | A | 12/1956 | Snyder et al. |
| 2,936,604 | A | 5/1960 | Glendening |
| 3,040,552 | A | 12/1960 | Platt et al. |
| 2,971,362 | A | 2/1961 | Olding |
| 3,027,742 | A | 4/1962 | Nowicki |
| 3,240,345 | A | 3/1966 | Butler et al. |
| 3,727,435 | A | 4/1973 | Menk |
| 3,769,818 | A | 11/1973 | Smith |
| 3,805,404 | A | 4/1974 | Gould |
| 3,836,001 | A | 9/1974 | Heldreth |
| 3,891,548 | A | 6/1975 | Marcussen |
| 3,896,641 | A | 7/1975 | Worst |
| 3,910,076 | A | 10/1975 | Ruble |
| 3,977,219 | A | 8/1976 | Bochan |
| 4,081,975 | A | 4/1978 | Wortham et al. |
| 4,417,457 | A | 11/1983 | Brenner |

(Continued)

FOREIGN PATENT DOCUMENTS

EP 0 735 179 A1 10/1996

(Continued)

*Primary Examiner* — Frankie L Stinson

(74) *Attorney, Agent, or Firm* — Birch, Stewart, Kolasch & Birch, LLP

(57) ABSTRACT

In a foreign materials filtering apparatus and a washing machine having the same, a filter cover is installed at a washing water circulating duct disposed inside a washing tub, and a net filter is installed at an inner side of the filter cover. Accordingly, the net filter is prevented from directly contacting laundry, thereby preventing the not filter and the laundry from being damaged. Furthermore, since the net filter is covered by the filter cover, the entire appearance is enhanced. Additionally, when the net filter is mounted at the filter cover, the filter unit becomes modularized to be facilitate a detachable mounting.

12 Claims, 13 Drawing Sheets

U.S. PATENT DOCUMENTS

| | | | |
|---|---|---|---|
| 4,566,970 | A | 1/1986 | Piai et al. |
| 4,622,142 | A | 11/1986 | Teranishi |
| 4,833,900 | A | 5/1989 | Babuin et al. |
| 5,018,372 | A | 5/1991 | Altnau, Sr. |
| 5,078,862 | A | 1/1992 | Justice |
| 5,353,612 | A | 10/1994 | Noguchi et al. |
| 5,437,789 | A | 8/1995 | Sabo et al. |
| 5,509,283 | A | 4/1996 | Lee et al. |
| 5,618,419 | A | 4/1997 | Fuerst |
| 5,829,275 | A | 11/1998 | Babuin et al. |
| 5,849,182 | A | 12/1998 | Shin |
| 5,858,220 | A | 1/1999 | Shin |
| 5,863,423 | A | 1/1999 | Shin et al. |
| 5,931,027 | A | 8/1999 | Shin |
| 5,989,418 | A | 11/1999 | Shin |
| 6,076,378 | A | 6/2000 | Shin |
| 6,841,058 | B2 | 1/2005 | Culvey et al. |
| 7,267,289 | B2 | 9/2007 | Lyons |
| 7,412,853 | B2 | 8/2008 | Hong et al. |
| 2001/0010165 | A1 | 8/2001 | Kubota et al. |
| 2004/0159130 | A1 | 8/2004 | Lee |
| 2005/0000920 | A1 | 1/2005 | Smolley |
| 2005/0132759 | A1 | 6/2005 | Guinibert et al. |
| 2005/0246843 | A1 | 11/2005 | Song et al. |
| 2006/0075790 | A1 | 4/2006 | Jeon et al. |
| 2006/0096335 | A1 | 5/2006 | Park et al. |
| 2006/0123854 | A1 | 6/2006 | Hong et al. |
| 2006/0185403 | A1 | 8/2006 | Ikemizu et al. |
| 2008/0141554 | A1 | 6/2008 | Bae et al. |
| 2008/0141734 | A1 | 6/2008 | Son et al. |
| 2008/0216518 | A1 | 9/2008 | Yoo et al. |
| 2008/0216519 | A1 | 9/2008 | Yoo et al. |
| 2008/0216520 | A1 | 9/2008 | Yoo et al. |
| 2008/0216522 | A1 | 9/2008 | Yoo et al. |
| 2008/0216523 | A1 | 9/2008 | Yoo et al. |
| 2008/0217243 | A1 | 9/2008 | Yoo et al. |
| 2008/0276659 | A1 | 11/2008 | Bae et al. |
| 2008/0276661 | A1 | 11/2008 | Bae et al. |
| 2008/0302138 | A1 | 12/2008 | Bae et al. |
| 2008/0313922 | A1 | 12/2008 | Bae et al. |
| 2009/0078007 | A1 | 3/2009 | Bae et al. |
| 2009/0100882 | A1 | 4/2009 | Bae et al. |
| 2009/0113745 | A1 | 5/2009 | Choi et al. |
| 2009/0120140 | A1 | 5/2009 | Choi et al. |

FOREIGN PATENT DOCUMENTS

| | | | | |
|---|---|---|---|---|
| JP | 30 10 182 | A1 | | 10/1981 |
| JP | 02-005998 | A | | 1/1990 |
| JP | 2-114993 | A | | 4/1990 |
| JP | 6-319895 | A | | 11/1994 |
| JP | 08-323096 | A | | 12/1996 |
| JP | 09-299685 | A | | 11/1997 |
| JP | 10-000293 | | * | 1/1998 |
| JP | 10-000293 | A | | 1/1998 |
| JP | 11-207091 | A | | 8/1999 |
| JP | 11-208901 | | * | 8/1999 |
| JP | 2000-354697 | A | | 12/2000 |
| KR | 10-2001-0073573 | A | | 8/2001 |
| KR | 10-2002-0045381 | A | | 6/2002 |
| WO | WO 2005/118940 | A1 | | 12/2005 |

* cited by examiner

FOREIGN MATERIALS FILTERING APPARATUS AND WASHING MACHINE HAVING THE SAME

RELATED APPLICATION

The present invention relates to subject matter contained in priority Korean Application No. 10-2007-0022177, filed on Mar. 6, 2007, which is herein expressly incorporated by reference in its entirety.

BACKGROUND OF THE INVENTION

1. Field of the Invention

The present invention relates to a foreign materials filtering apparatus, and more particularly, to a foreign materials filtering apparatus for a washing machine and a washing machine having the same.

2. Description of the Background Art

Generally, a washing machine is largely classified into a drum type washing machine that a washing tub rotates in a horizontal direction with respect to the ground, and a pulsator type washing machine the washing tub rotates in a vertical direction with respect to the ground. According to the drum type washing machine, while a washing tub rotates, laundry comes into friction with an inner wall of the washing tub or drops from the washing tub thereby to be cleaned. On the contrary, according to the pulsator type washing machine, laundry comes into friction with a water current generated while a pulsator rotates, or is entangled by the pulsator, thereby being cleaned.

In the conventional pulsator type washing machine, a foreign materials filtering apparatus for filtering each kind of foreign materials such as nap generated from laundry during a washing process is installed above the washing tub.

In the foreign materials filtering apparatus, a filtering net for filtering foreign materials is attached to a frame detachably mounted at the washing tub. The frame is formed of an elastic material in a rectangular belt shape so as to be detachably mounted at the washing tub. And, the filtering net is formed of a mesh-shaped fibrous material or a material similar thereto having a certain aperture ratio so as to pass washing water and filter foreign materials.

In a washing machine having the foreign materials filtering apparatus, a pulsator provided on a bottom surface of a washing tub rotates to generate a water current, and by the generated water current, washing water rises along a passage formed between an inner wall and an outer wall of the washing tub. The risen washing water is introduced into the washing tub via the foreign materials filtering apparatus. While the washing water passes through the foreign materials filtering apparatus, foreign materials such as nap detached from laundry and mixed with the washing water are filtered by passing through a filtering net of the foreign materials filtering apparatus.

However, the conventional foreign materials filtering apparatus has the following problems.

The filtering net is installed to be exposed to inside of the washing tub, thereby repeatedly coming in contact with laundry. Accordingly, the filtering net or laundry may be damaged, or the frame may be detached from the washing tub, which causes the entire appearance to be degraded.

SUMMARY OF THE INVENTION

Therefore, it is an object of the present invention to provide a foreign materials filtering apparatus capable of preventing a filtering net and laundry from being damaged by preventing friction therebetween, and capable of preventing a frame from being detached from a washing tub, and a washing machine having the same.

It is another object of the present invention to provide a foreign materials filtering apparatus capable of easily installing a filtering net and enhancing the entire appearance, and a washing machine having the same.

To achieve these and other advantages and in accordance with the purpose of the present invention, as embodied and broadly described herein, there is provided a foreign materials filtering apparatus, comprising: a washing water circulating duct having one or more washing water inlets; a filter cover mounted so as to cover the washing water inlets; and a net filter disposed between the washing water circulating duct and the filter cover, for filtering foreign materials from washing water introduced through the washing water inlets.

To achieve these and other advantages and in accordance with the purpose of the present invention, as embodied and broadly described herein, there is also provided a washing machine having a foreign materials filtering apparatus, comprising: a cabinet; a reservoir received in the cabinet, for containing washing water therein; a washing tub received in the reservoir, and rotated at the time of a washing or dehydrating process, for containing laundry therein; a pulsator installed at the washing tub, for stirring laundry; and a foreign materials filtering apparatus comprising: a washing water circulating duct installed on an inner circumferential surface of the washing tub, having a washing water guiding passage, and having one or more washing water inlets inside the washing water guiding passage, for circulating washing water when the pulsator rotates; a filter cover mounted at the washing water circulating duct and having drain holes so as to communicate with the washing water inlets; and a net filter disposed between the washing water circulating duct and the filter cover, for filtering foreign materials from washing water.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a foreign materials filtering apparatus and a washing machine having the same according to the present invention will be explained in more detail with reference to the attached drawings.

Figure 1:
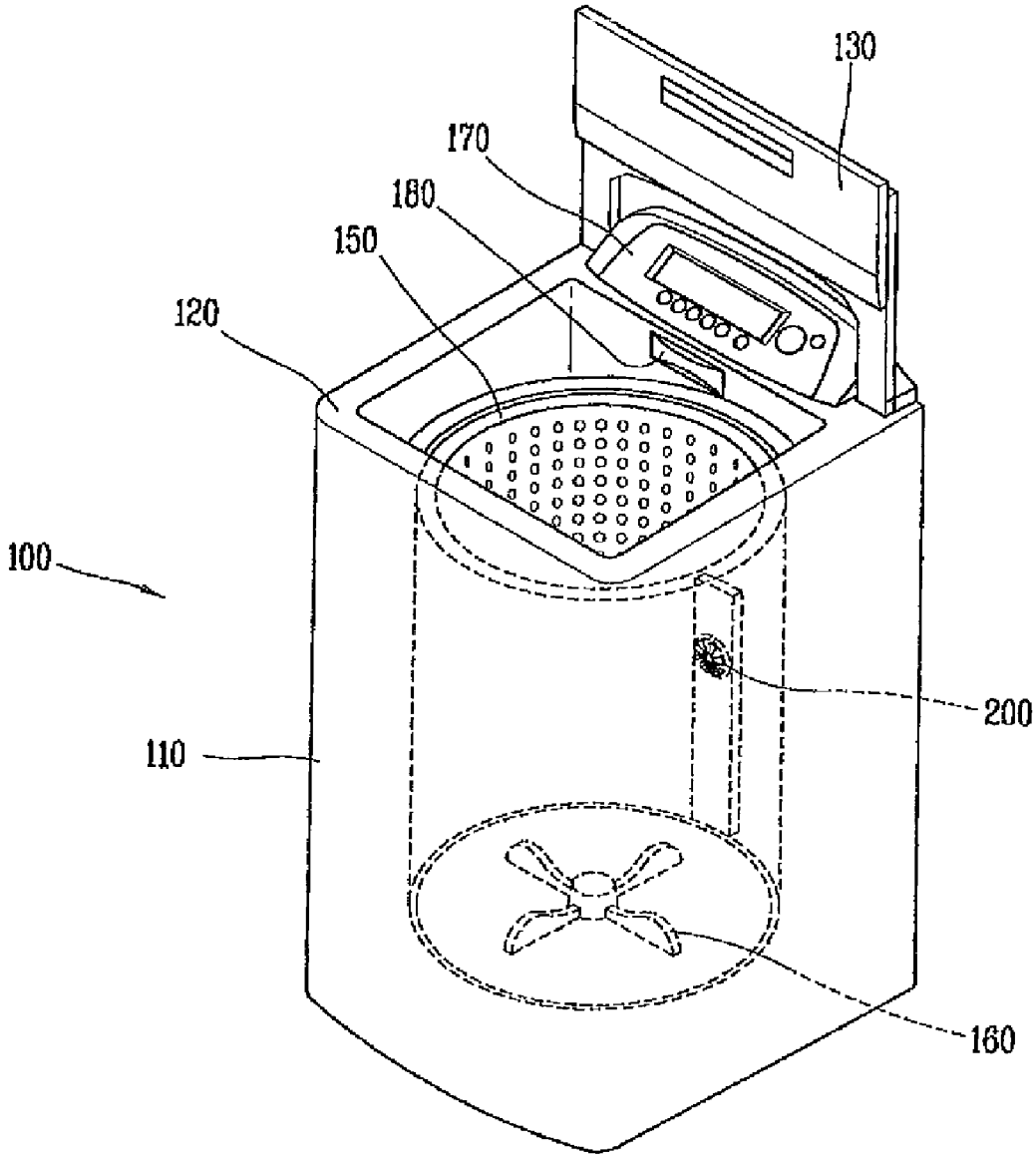
FIGS. 1 and 2 are respectively perspective and longitudinal sectional views of a pulsator type washing machine to which a foreign materials filtering apparatus according to the present invention is applied.
Figure 2:
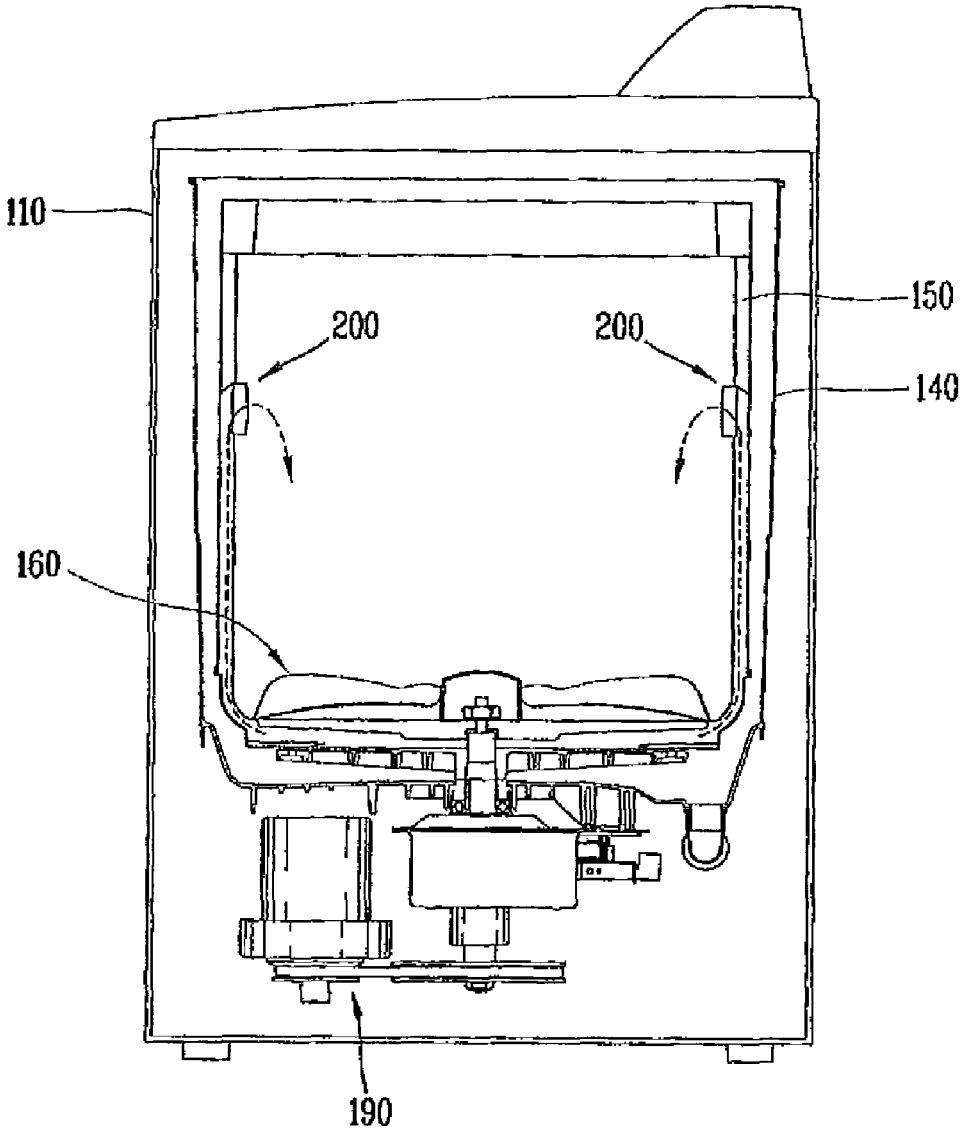

FIGS. 1 and 2 are respectively perspective and longitudinal sectional views of a pulsator type washing machine to which a foreign materials filtering apparatus according to the present invention is applied.

As shown, a washing machine 100 to which a foreign materials filtering apparatus according to the present invention is applied, comprises: a cabinet 110 that forms the appearance; a top cover 120 mounted at an upper side of the cabinet 110; and a lid 130 mounted at an upper side of the top cover 120, for opening and closing a washing tub 150 to be later explained.

A reservoir 140 for containing washing waster therein is installed in the cabinet 110, and a washing tub 150 containing laundry therein and washing the laundry while rotating is installed in the washing tub 140. A pulsator 160 for stirring laundry is installed at a lower surface of the washing tub 150, and a foreign materials filtering apparatus 200 is installed at a part on an inner wall of the washing tub 150.

A control panel 170 for controlling an operation of the washing machine is installed at one side of the top cover 120, and a detergent box 180 is inserted into an inner inclination surface of the top cover 120.

Unexplained reference numeral 190 denotes a driving unit.

The operation of the washing machine according to the present invention will be explained.

First, laundry is put into the washing tub 150, and washing conditions are inputted by pressing a course selection button, etc. mounted at the control panel 170. Then, an operation button is pressed to start a washing process, and thereby washing water is introduced into the washing tub 150. As the washing water reaches a certain level, the pulsator 160 rotates thus to start a washing process.

As the pulsator 160 rotates, a centrifugal force is applied to the washing water. By the centrifugal force, the washing water is moved toward an inner wall of the washing tub 150, and circulates along the inner wall. As the washing tub 150 and the pulsator 160 alternately rotate with a certain time gap therebetween in opposite directions to each other, a washing process is performed while water current and laundry are mixed to each other. Here, the washing water passes through the foreign materials filtering apparatus 200 while circulating toward inside of the washing tub 150. As the washing water passes through the foreign materials s filtering apparatus 200, foreign materials such as nap mixed with the washing water are filtered by the foreign materials filtering apparatus 200.

FIGS. 3 to 10 are views respectively showing a foreign materials filtering apparatus according to the present invention.

Figure 3:
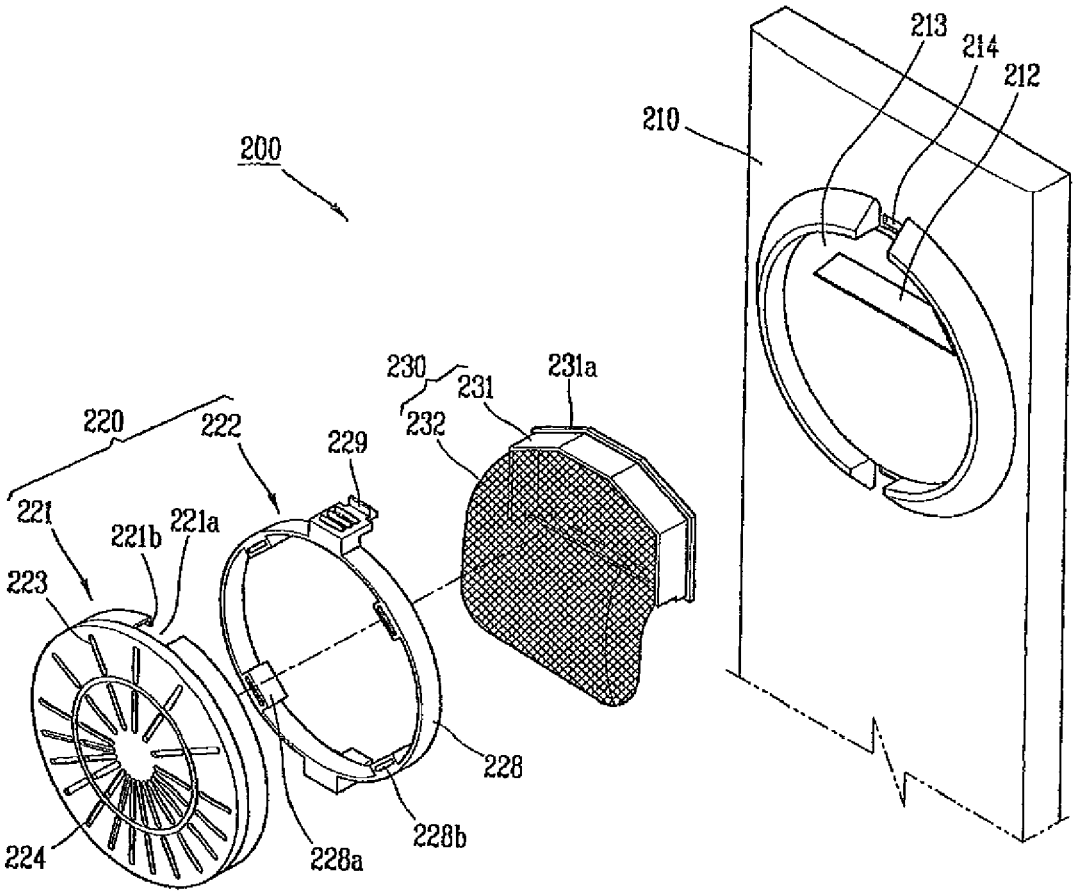
FIG. 3 is a frontal exploded perspective view of the foreign materials filtering apparatus of FIG. 1.
Figure 4:
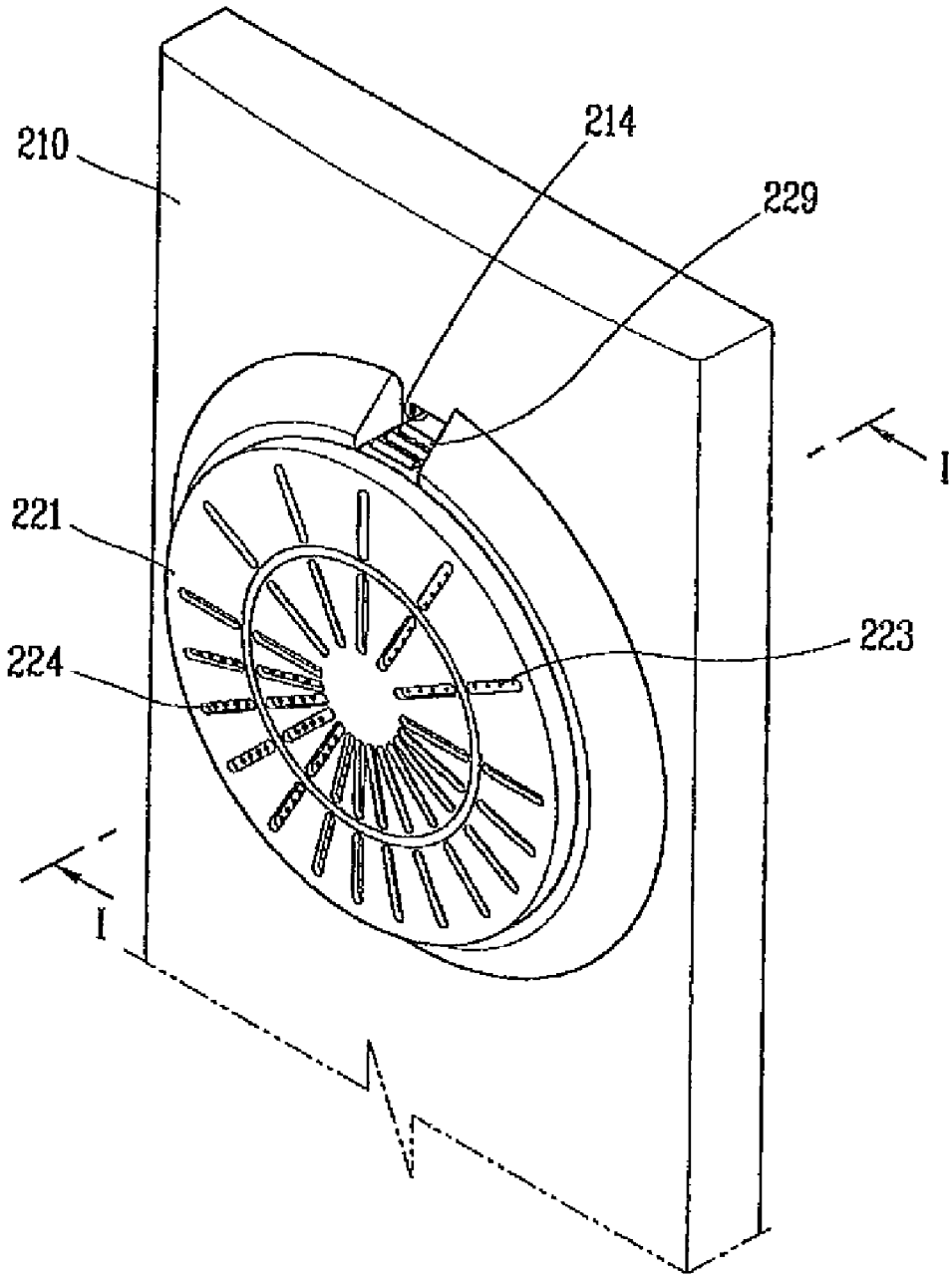
FIG. 4 is a frontal assembled perspective view of the foreign materials filtering apparatus of FIG. 1.
Figure 5:
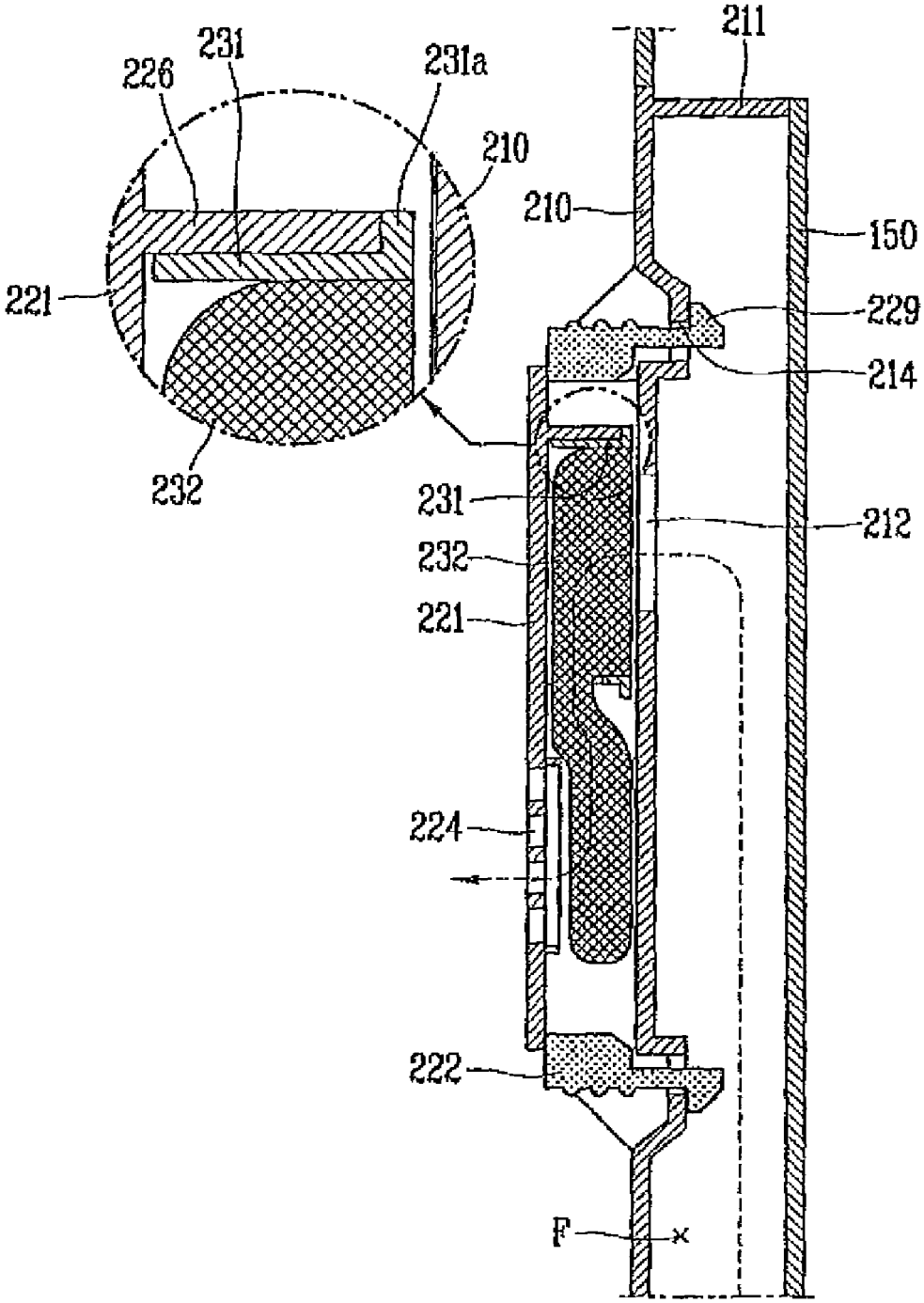
FIG. 5 is a lateral longitudinal sectional view of the foreign materials filtering apparatus of FIG. 1 taken along line 'I-I'.
Figure 6:
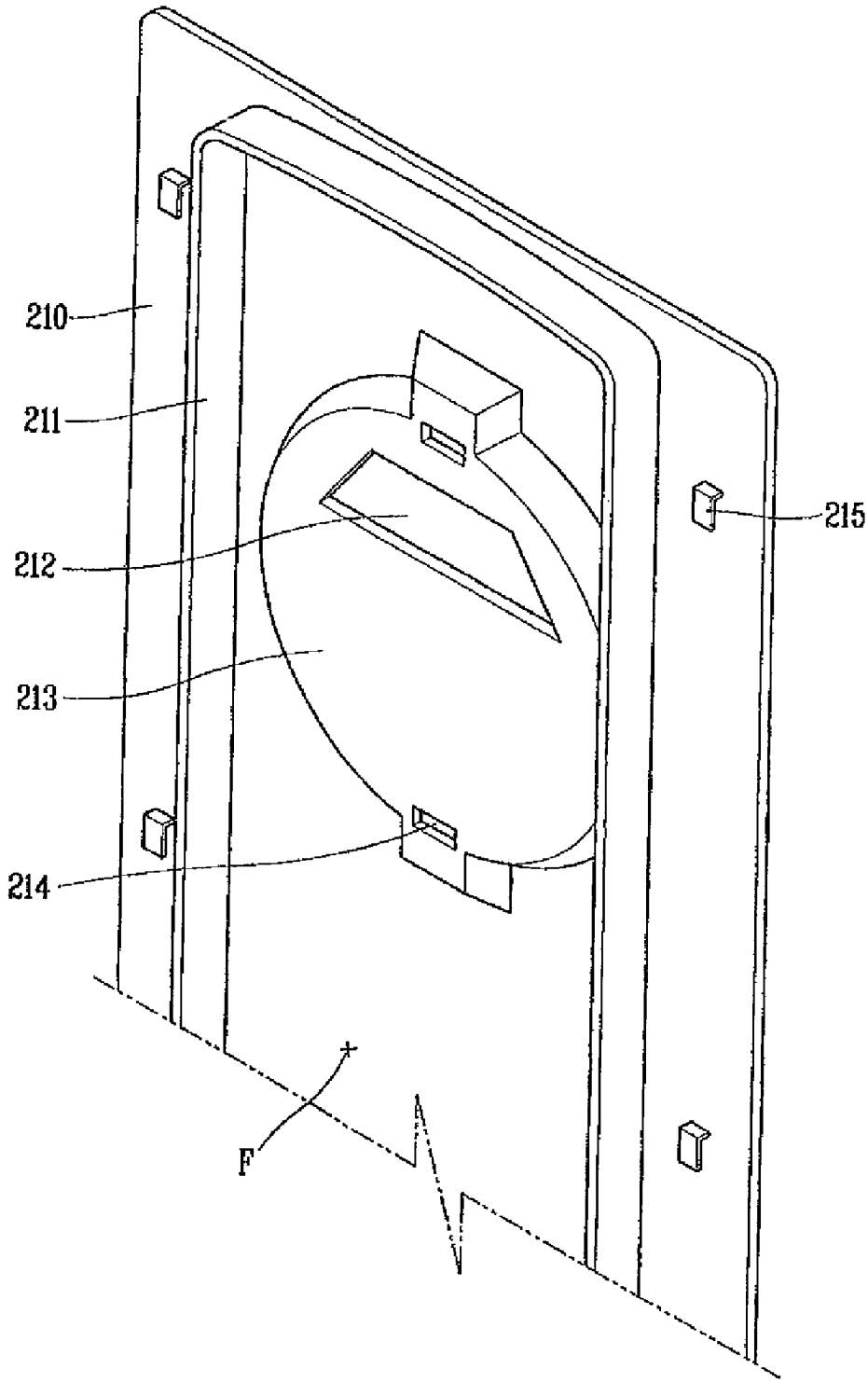
FIG. 6 is a rear perspective view of a washing water circulating duct of the foreign materials filtering apparatus of FIG. 1

As shown in FIG. 3, a foreign materials filtering apparatus 200 according to the present invention comprises a washing water circulating duct 210 installed on an inner wall surface of a washing tub 150 of FIG. 1, a filter cover 220 detachably mounted at the washing water circulating duct 210, and a net filter 230 disposed on a rear surface of the filter cover 220 for filtering foreign materials from washing water.

As shown in FIGS. 3 to 6, the washing water circulating duct 210 is formed in a rectangular plate shape approximately same as an inner all surface of the washing tub 150. At upper, right and left sides of a rear surface of the washing water circulating duct 210, provided is a washing water guiding protrusion 211 long protruded in horizontal and vertical directions so as to form a washing water guiding passage (F) together with an inner circumferential surface of the washing tub 150. One or more washing water inlets 212 are formed inside the washing water guiding passage (F) at a nearly middle height of the washing water circulating duct 210. A cover mounting groove 213 for mounting the filter cover 220 is formed at the periphery of a front surface of the washing water inlet 212. A hook groove 214 for mounting a hook protrusion 229 of a handle 222 to be later explained is formed at upper and lower sides of the cover mounting groove 213, respectively. Here, the hook protrusion may be formed at the washing water circulating duct, and the hook groove may be formed at the filter cover.

As shown in FIG. 3, the filter cover 220 includes a cap 221 for covering the washing water inlet 212 of the washing water circulating duct 210, and a handle 222 coupled to the cap 221 thus to be detachably mounted at the washing water circulating duct 210.

Figure 7:
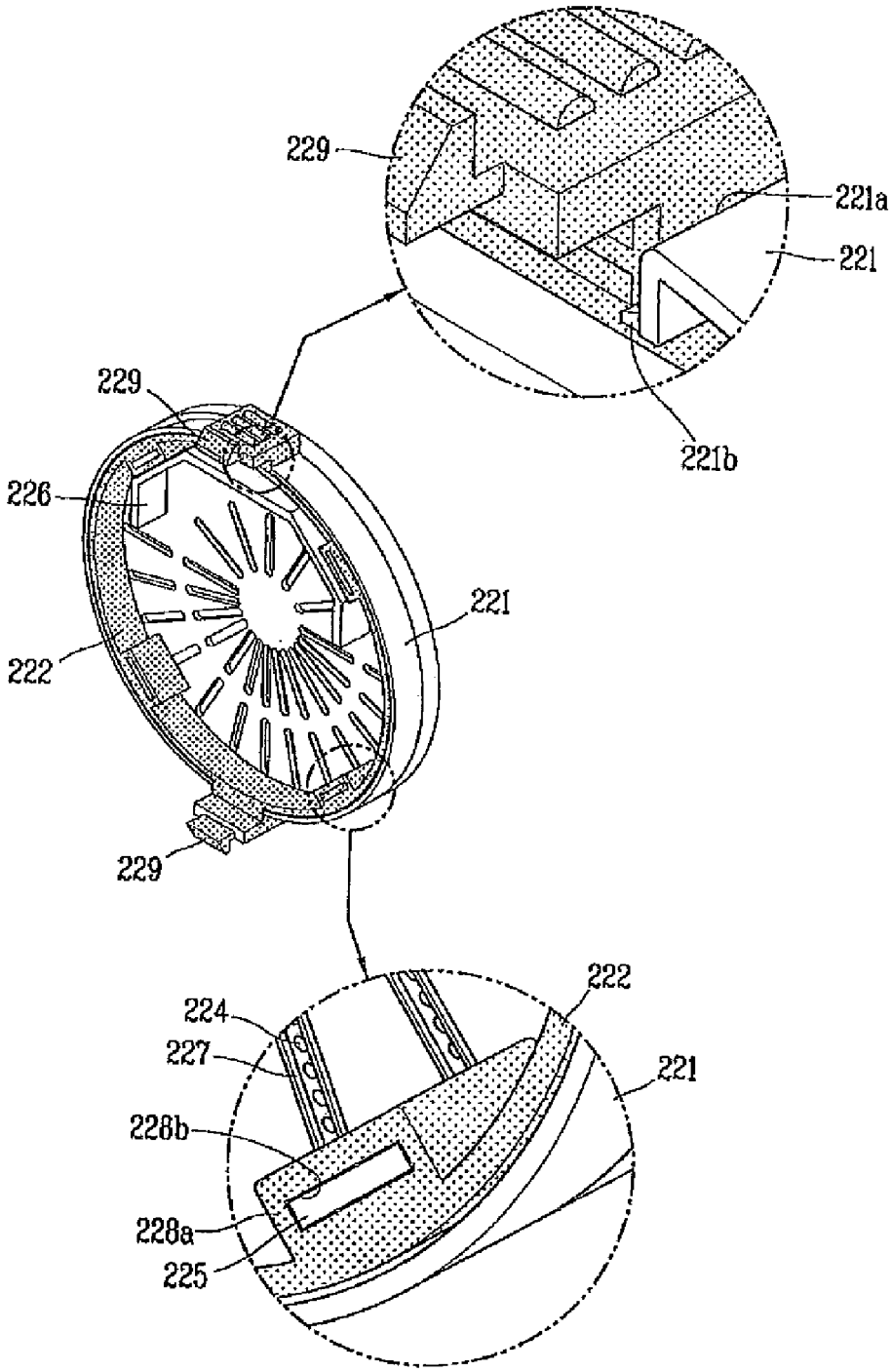
FIGS. 7 and 8 are rear perspective views showing embodiments of an assembled state between a cap and a handle of the foreign materials filtering apparatus of FIG. 1.

As shown in FIGS. 3 and 7, the cap 221 having a disc shape is provided with a plurality of minute holes 223 at an upper portion thereof in a radius direction along an circumferential direction, and is provided with a plurality of drain holes 224 at a lower portion thereof in a radius direction along an circumferential direction. A handle fixing rib 225 for insertion-fixing the handle 222 is formed at the edge of a rear surface of the cap 221, and a filter fixing rib 226 for fixing the net filter 230 is formed at an upper portion of the rear surface of the cap 221. An interval protrusion 227 is formed at the periphery of each column of the drain holes 224, thereby preventing the drain holes 224 from being blocked by a filtering net 232 of the net filter 230 when washing water is introduced into the net filter 230. A hook inserting groove 221*a* for inserting the hook protrusion 229 of the handle 222 is formed at upper and lower ends of the rear surface of the cap 221, respectively. And, a handle locking protrusion 221 b for locking the handle 222 is formed at both sides of an inner surface of the hook inserting groove 221 a, respectively.

Figure 8:
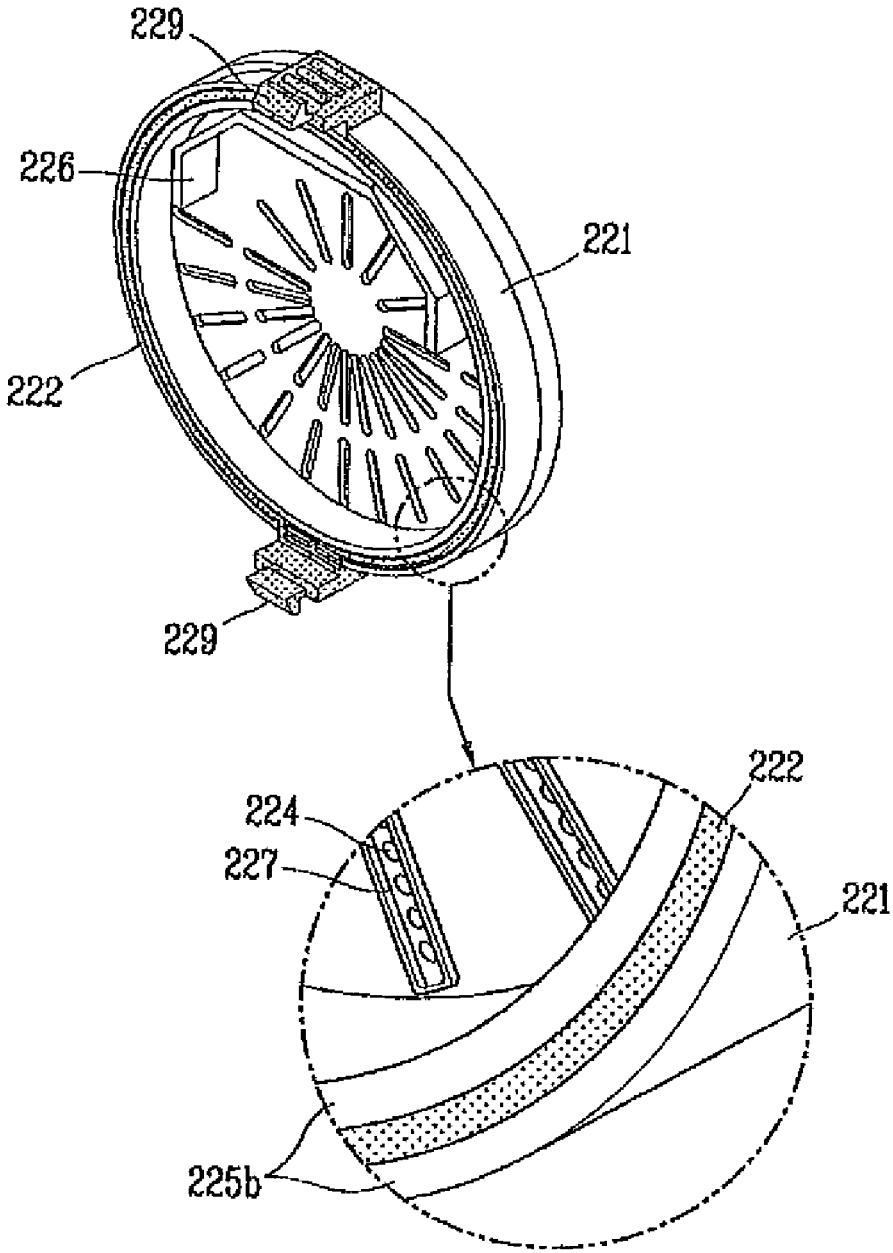

As shown in FIG. 7, the handle fixing rib 225 may be formed in plurality with a certain interval therebetween in a circumferential direction, and may be protruding with a rectangular or circular sectional shape thus to be inserted into a fixing groove 228*b* of the handle 222. As shown in FIG. 8, the handle fixing rib 225 may be disposed inside and outside the handle 222 in a circular or arc shape so as to fix the handle 222 therebetween.

Figure 9:
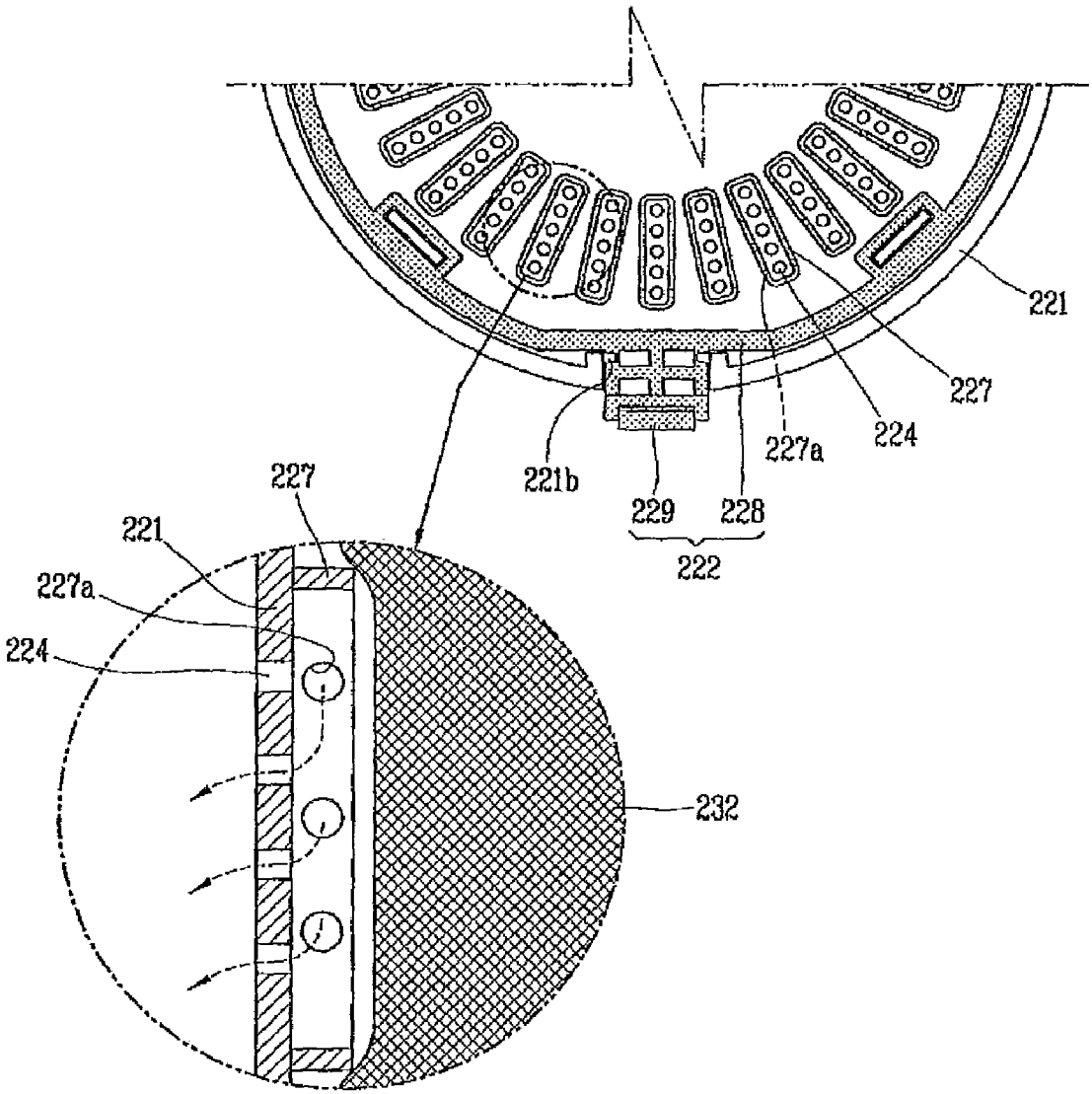
FIGS. 9 and 10 are rear planar views showing embodiments of a cap of the foreign materials filtering apparatus of FIG. 1.

As shown in FIG. 9, the interval protrusion 227 may be formed in a long belt shape in a radial direction so as to receive all the drain holes 224 of each column. A plurality of drain guiding holes 227*a* for guiding washing water to be introduced into the drain holes 224 may be formed with a certain interval therebetween along the interval protrusion 227.

Figure 10:
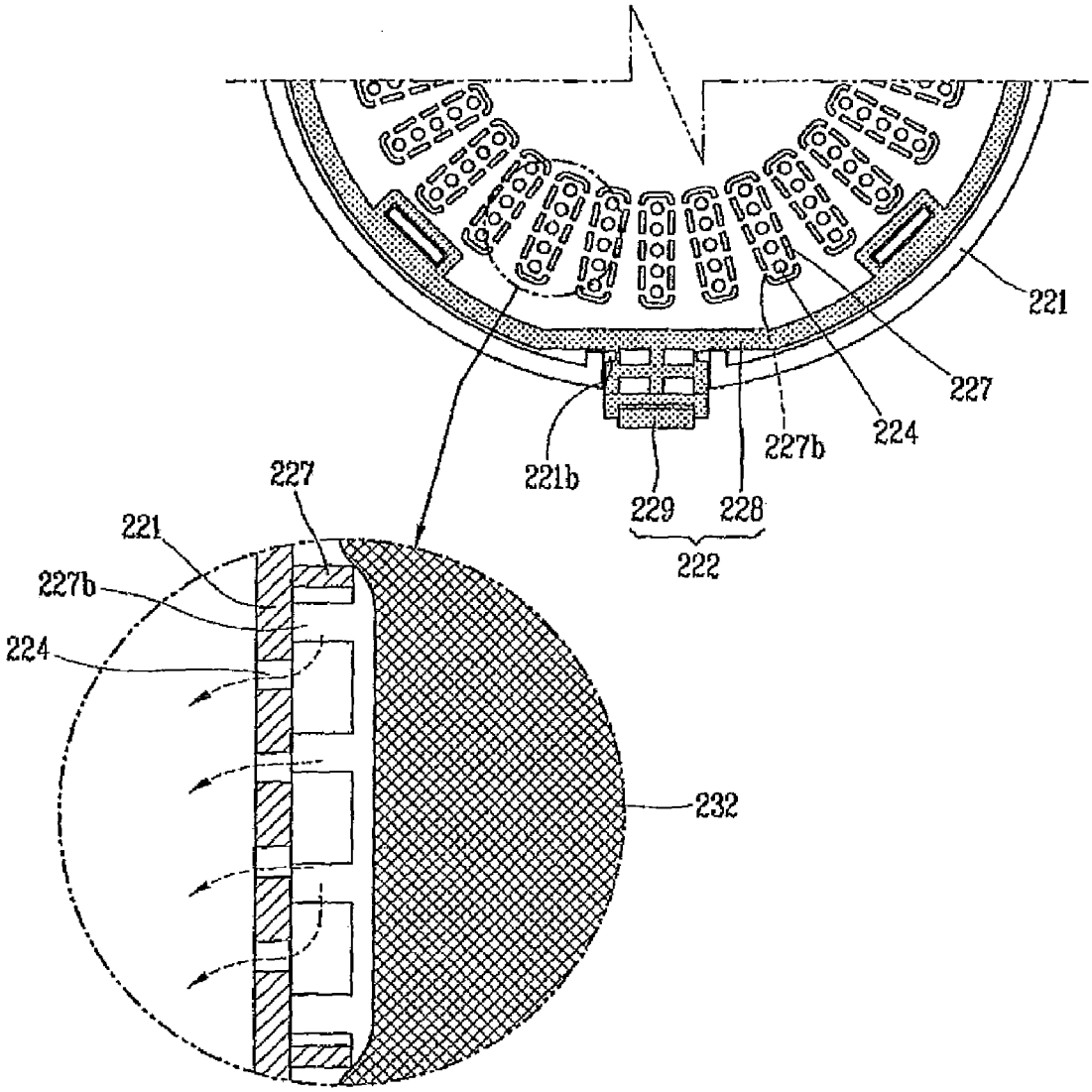

As shown in FIG. 10, a plurality of drain guiding grooves 227*b* may be protrudingly formed between each interval protrusion 227 with a certain gap therebetween along the periphery of the drain holes 224 of each column.

As shown in FIGS. 3 and 7, the handle 222 includes a handle body 228 having a circular belt shape, and a hook protrusion 229 formed at upper and lower sides of the handle body 229 and inserted into the hook groove 214 of the washing water circulating duct 210. An extension portion 228*a* is formed at a part of the handle body 228, and a fixing groove 228*b* for fixing the handle fixing rib 225 of the cap 221 is formed at the extension portion 228*a*. The handle 222 may be formed of the same material as the cap 221. However, preferably the handle 222 may be formed of a material softer than that of the cap 221 so as to enhance a coupling force with the cap 221 by being elastically restored when repeatedly detachably mounted. For instance, the cap 221 may be formed of a hard PC material, and the handle 222 may be formed of a soft POM material.

As shown in FIG. 3, the net filter 230 includes a frame 231 formed of a PC or POM material for maintaining a certain shape so as to be inserted into the filter fixing rib 226 of the cap 221, and a filtering net 232 attached to the frame 231 and having a mesh shape for filtering foreign materials from washing water.

The frame 231 is formed to have the same shape as the filter fixing rib 226 of the cap 221, and preferably, is formed to have a diamond shape or a rectangular shape, etc. so as to form an inlet of the filtering net 232. The frame may be formed so that its upper, right and left sides can have the same height as the filter fixing rib of the cap 221, but its lower side can have a height lower than the filter fixing rib so as to downwardly extend the filtering net. A stopping jaw 231 a for limiting an inserted depth of the frame 231 to the cap 221 by locking the frame 231 by the filter fixing rib is outwardly curved at a rear end of the frame.

Although not shown, the net filter 230 may be insertion-coupled to an outer surface of the filer fixing rib 226.

Unexplained reference numeral 215 denotes a duct fixing protrusion.

Hereinafter, processes for assembling the foreign materials filtering apparatus according to the present invention will be explained.

First, the fixing groove 228*b* of the handle 222 is fitted into the handle fixing rib 225 of the cap 221, and the hook protrusion 229 of the handle 222 is inserted into the hook inserting groove 221*a* of the cap 221, thereby coupling the handle 222 to the cap 221. Here, the handle locking protrusion 221*b* is protrudingly formed at right and left sides of the hook inserting groove 221*a* in a circumferential direction, thereby supporting upper and lower sides of the handle 222 by locking an extended portion between the handle body 228 of the body 222 and the hook protrusion 229.

Then, the frame 231 of the net filter 230 is coupled to the filter fixing rib 226 of the cap 221, thereby detachably mounting the cap 221, the handle 222, and the net filter 230 to the washing water circulating duct 210 as a unit. Here, a fixing jaw 231*a* is formed at the frame 231 of the net filter 230 with a multi-step, thereby being supported by being locked by the end of the filter fixing rib 226.

Then, the hook protrusion 229 of the handle 222 being held by a user's thumb and index finger is pressed, and then is released when mounted at the hook groove 214 of the washing water circulating duct 210. Accordingly, the handle body 228 is elastically restored to the original shape, and thus the hook protrusion 229 is fitted into the hook groove 214. Here, the net filter 230 becomes positioned between the washing water circulating duct 210 and the filter cover 220.

Hereinafter, processes for filtering foreign materials from the washing machine to which the foreign materials filtering apparatus is applied will be explained.

First, once the pulsator 160 rotates to generate a water current, washing water is moved toward an inner wall surface of the washing tub 150 by a centrifugal force due to the water current. The washing water rises along the washing water circulating duct 210 mounted on the inner wall surface of the washing tub 150, and then is introduced into the foreign materials filtering apparatus 200 through the washing water inlet 212 formed at an intermediate height of the washing water circulating duct 210.

Then, the washing water introduced into the foreign materials filtering apparatus 200 is guided to the filtering net 232 of the net filter 230 by the cap 221 disposed at the front side, and then is introduced into the washing tub 150 through the drain holes 224 of the cap 221 via the filtering net 232. Here, foreign materials such as nap are filtered by the filtering net 232. While the washing water is introduced into the filtering net 232, the drain holes 224 of the cap 221 may be blocked by the filtering net 232. However, the drain holes 224 can maintain a certain interval from the filtering net 232 owing to the interval protrusion 225. Accordingly, the washing water having passed through the filtering net 232 can smoothly drain.

Next, the foreign materials filtering apparatus 200 is disassembled in a reverse order to the aforementioned assembling order, thereby separating the net filter 232 therefrom 200 and removing foreign materials from the net filter 232. Then, the foreign materials filtering apparatus 200 is assembled again to perform a washing process.

Hereinafter, another embodiment of the filter cover of the foreign materials filtering apparatus according to the present invention will be explained.

Figure 11:
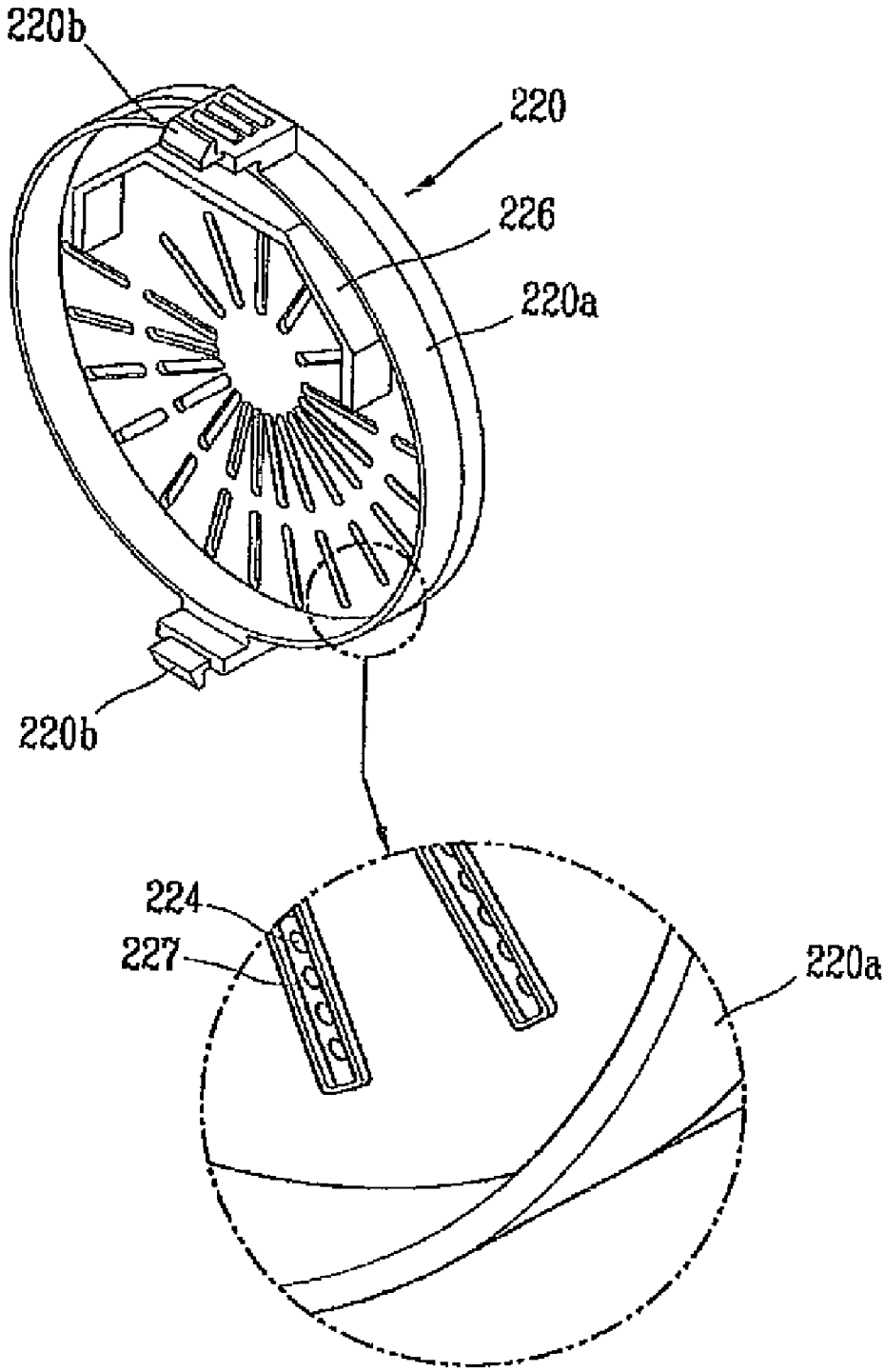
FIG. 11 is a rear perspective view showing another embodiment of a filter cover of the foreign materials filtering apparatus of FIG. 1.

According to the aforementioned embodiment, the cap 221 and the handle 222 of the filter cover 220 are individually fabricated to be assembled to each other. However, according to another embodiment, the cap 221 and the handle 222 are integrally fabricated. As shown in FIG. 11, the filter cover 220 is composed of a cap portion 220*a* having a disc shape, and handle portions 220*b* integrally formed at upper and lower sides of the cap portion 220*a* and each having a hook protrusion detachably mounted at the hook groove 214 of FIG. 5 of the washing water circulating duct 210.

The filter cover according to another embodiment has the configuration, assembly processes, and processes for filtering foreign materials similar to those according to the aforementioned embodiment, and thus its detailed explanation will be omitted except the following advantages. As the cap portion 220*a* and the handle portion 220*b* are integrally formed, the process for assembling them to each other is not required thus to reduce the fabrication cost. Furthermore, as the cap portion 220*a* and the handle portion 220*b* are integrally formed, the handle portion 220*b* is prevented from being detached from the cap portion 220*a* thus to enhance the reliability of the washing machine.

Hereinafter, still another embodiment of the filter cover of the foreign materials filtering apparatus according to the present invention will be explained.

According to still another embodiment, the filter cover 220 is screw-coupled to the washing water circulating duct 210 differently from the aforementioned embodiments using hooks instead of screws. To this end, through holes 222*a* are formed at the handle 222 or a handle portion (not shown), coupling holes (not shown) are formed at the washing water circulating duct 210 in correspondence to the through holes 222*a*, and the through holes 222*a* and the coupling holes are coupled to each other by screws (not shown). Here, the screws (not shown) may be formed of a corrosion-resistant metallic material or a plastic material with consideration of contact to washing water.

The screw-coupling between the filter cover 220 and the washing water circulating duct 210 provides more enhanced coupling force than the hook-coupling therebetween, even though it causes more inconvenience when detachably mounting the filter cover 220 to the washing water circulating duct 210. By the screw-coupling, the foreign materials filtering apparatus can be more stably maintained.

Hereinafter, an assembled position of the net filter of the foreign materials filtering apparatus according to the present invention will be explained.

Figure 12:
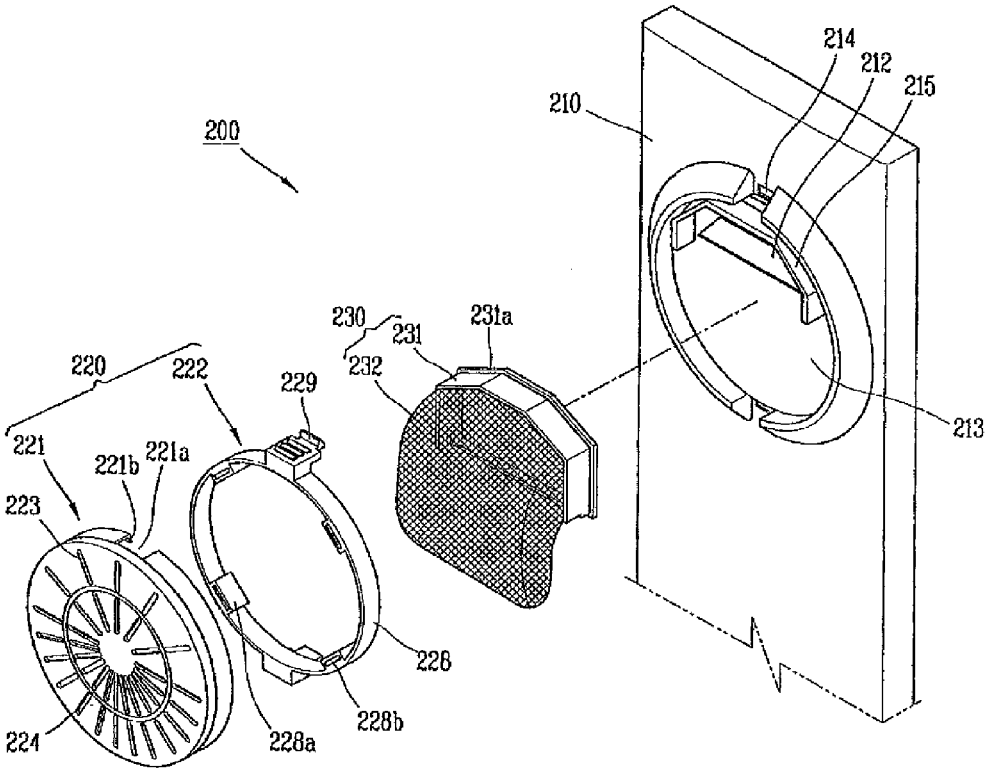
FIGS. 12 and 13 are lateral exploded perspective and longitudinal sectional views, respectively showing another embodiment of an assembled state of a net filter of the foreign materials filtering apparatus of FIG. 1.
Figure 13:
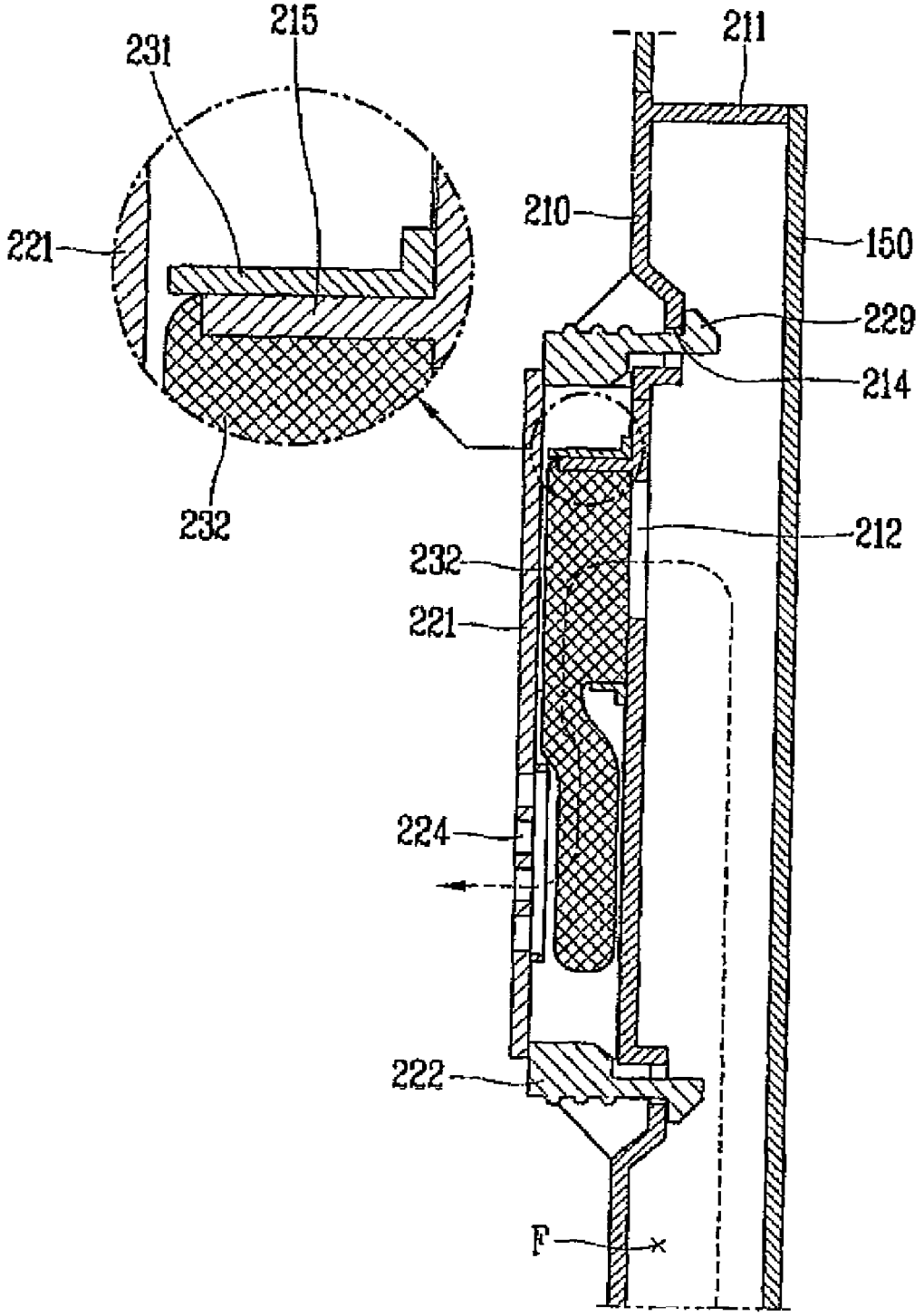

The net filter 230 is coupled to the filter cover 220 to be modularized according to the aforementioned embodiments, whereas according to still another embodiment shown in FIGS. 12 and 13, the net filter 230 is detachably mounted at the washing water circulating duct 210. More concretely, a filter fixing rib 216 is formed at the periphery of the washing water inlet 212 of the washing water circulating duct 210, thereby fixing the frame 231 of the net filter 230 thereto. Also, the filter cover 220 is mounted at the washing water circulating duct 210 thus to cover the net filter 230, thereby not exposing the net filter 230 to inside of the washing tub 150.

As the net filter 230 and the filter cover 220 are not modularized but are separately fabricated from each other, a double operation is required at the time of assembly or disassembly processes. However, the separate fabrication enables the filter cover 220 to be easily fabricated, and the net filter to be assembled to a precise position of the washing water inlet 212 of the washing water circulating duct 210. Furthermore, the net filter 230 is prevented from directly contacting laundry due to the filter cover 220, thereby preventing the net filter 230 or the laundry from being damaged, which is the same effect as the aforementioned embodiments.

In the foreign materials filtering apparatus and the washing machine having the same according to the present invention, the filter cover is installed at the washing water circulating duct disposed inside the washing tub, and the net filter is installed at an inner side of the filter cover. Accordingly, the net filter is prevented from directly contacting laundry, thereby preventing the net filter and laundry from being damaged. Furthermore, since the net filter is covered by the filter cover, the entire appearance is enhanced. Additionally, when the net filter is mounted at the filter cover, the filter unit becomes modularized to facilitate a detachable mounting.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A foreign materials filtering apparatus, comprising:

a washing water circulating duct having one or more washing water inlets;

a filter cover mounted so as to cover the washing water inlets; and a net filter disposed between the washing water circulating duct and the filter cover, for filtering foreign materials from washing water introduced through the washing water inlets, wherein a filter fixing rib for coupling the net filter for modularization is formed at the filter cover, wherein the filter cover is provided with drain holes so as to communicate with the washing water inlets, and wherein an interval protrusion is formed at the periphery of the drain holes so as to separate the net filter from the filter cover.

2. The foreign materials filtering apparatus of claim 1, wherein the washing water circulating duct is mounted on an inner circumferential surface of a washing tub so as to form a washing water guiding passage together with the inner circumferential surface of the washing tub.

3. The foreign materials filtering apparatus of claim 2, wherein a washing water guiding protrusion is protrudingly formed in a vertical direction at right and left sides of a rear surface of the washing water circulating duct facing the washing tub, and the one or more washing water inlets are formed inside the washing water guiding passage formed by the washing water guiding protrusion.

4. The foreign materials filtering apparatus of claim 1, wherein a hook protrusion is formed at one of the washing water circulating duct and the filter cover, and a hook groove for detachably mounting the hook protrusion is formed at the other.

5. The foreign materials filtering apparatus of claim 1, wherein the washing water circulating duct and the filter cover are coupled to each other by an additional coupling member.

6. The foreign materials filtering apparatus of claim 1, wherein the filter cover comprises:

a cap for covering the washing water inlet of the washing water circulating duct; and a handle coupled to the cap thus to be mounted at the washing water circulating duct.

7. The foreign materials filtering apparatus of claim 6, wherein the cap and the handle are formed of different materials from each other.

8. The foreign materials filtering apparatus of claim 6, wherein the handle is formed of a material softer than that of the cap.

9. The foreign materials filtering apparatus of claim 1, wherein the interval protrusion is formed in a belt shape so as to surround the drain holes.

10. The foreign materials filtering apparatus of claim 9, wherein drain guiding holes or drain guiding grooves for guiding washing water to be introduced into the drain holes are formed at the interval protrusion.

11. The foreign materials filtering apparatus of claim 1, wherein the interval protrusion is formed in plurality with a certain gap therebetween along the periphery of the drain holes.

12. The foreign materials filtering apparatus of claim 1, wherein the filter cover comprises:

a cap portion for covering the washing water inlets of the washing water circulating duct; and a handle portion integrally formed at the cap portion and mounted at the washing water circulating duct.

* * * * *